US010232384B2

(12) United States Patent
Hawkins

(10) Patent No.: US 10,232,384 B2
(45) Date of Patent: Mar. 19, 2019

(54) SHOWERHEAD ASSEMBLY WITH RETRACTABLE AND EXTENDABLE ANCILLARY NOZZLES

(71) Applicant: FAN FI INTERNATIONAL, INC., Reno, NV (US)

(72) Inventor: Travis Hawkins, Reno, NV (US)

(73) Assignee: FAN FI INTERNATIONAL, INC. CA (US)

( * ) Notice: Subject to any disclaimer, the term of this patent is extended or adjusted under 35 U.S.C. 154(b) by 35 days.

(21) Appl. No.: 15/451,753

(22) Filed: Mar. 7, 2017

(65) Prior Publication Data

US 2018/0257090 A1 Sep. 13, 2018

(51) Int. Cl.

| | |
|---|---|
| ***E03C 1/00*** | (2006.01) |
| ***B05B 1/18*** | (2006.01) |
| ***B05B 1/16*** | (2006.01) |
| ***E03C 1/02*** | (2006.01) |
| ***E03C 1/06*** | (2006.01) |
| ***B65H 75/44*** | (2006.01) |
| ***B65H 75/48*** | (2006.01) |
| ***B05B 15/62*** | (2018.01) |
| ***B05B 15/65*** | (2018.01) |

(52) U.S. Cl.

CPC ..... *B05B 1/185* (2013.01); *B05B 1/169* (2013.01); *B05B 15/62* (2018.02); *B05B 15/65* (2018.02); *B65H 75/4431* (2013.01); *B65H 75/4471* (2013.01); *B65H 75/4478* (2013.01); *B65H 75/486* (2013.01); *E03C 1/025* (2013.01); *E03C 1/06* (2013.01)

(58) Field of Classification Search

CPC ..... E03C 1/04; E03C 1/0404; E03C 1/06; B65H 75/4431; B65H 75/4471; B65H 75/4478; B65H 75/486; B05B 1/169; B05B 1/185; B05B 15/62; B05B 15/65

See application file for complete search history.

(56) References Cited

U.S. PATENT DOCUMENTS

| | | | | |
|---|---|---|---|---|
| 1,120,341 | A * | 12/1914 | Smith | B65H 75/4431 242/385.4 |
| 3,817,247 | A * | 6/1974 | Mills | A61M 3/025 604/150 |
| 5,093,942 | A | 3/1992 | Lang | |
| 5,678,258 | A | 10/1997 | Healy | |
| 6,415,461 | B1 | 7/2002 | Singer | |
| 9,242,259 | B2 | 1/2016 | Jeronimus | |
| 2004/0237186 | A1 | 12/2004 | Petrovic et al. | |
| 2008/0185456 | A1* | 8/2008 | McCabe | E03C 1/0408 239/197 |

FOREIGN PATENT DOCUMENTS

| | | |
|---|---|---|
| EP | 1793051 A2 | 11/2006 |
| GB | WO2009019491 | 2/2009 |

* cited by examiner

*Primary Examiner* — Viet Le

(74) *Attorney, Agent, or Firm* — David Duckworth

(57) ABSTRACT

A showerhead assembly is provided having a primary showerhead and one or more retractable and extendable ancillary showerheads. The showerhead assembly includes a showerhead body having a central conduit for transporting water to the primary showerhead's nozzles. In addition, the showerhead body includes one or more ancillary conduits for transporting water to one or more ancillary showerheads. The ancillary showerheads are connected to the showerhead body by flexible hoses which can be extended or retracted from the showerhead body.

7 Claims, 12 Drawing Sheets

SHOWERHEAD ASSEMBLY WITH RETRACTABLE AND EXTENDABLE ANCILLARY NOZZLES

BACKGROUND OF THE INVENTION

The present invention relates to showerheads. More particularly, the present invention relates to handheld showerheads producing a plurality of spray patterns.

Showerheads are commercially available in numerous designs and configurations for use in showers, faucets, spas, sprinklers and other personal and industrial systems. The vast majority of showerheads include spray heads which may be categorized as being either stationary or oscillating and have either fixed or adjustable openings. Stationary spray heads with fixed jets are the simplest constructions consisting essentially of a central conduit connected to one or more spray jets directed to produce a constant pattern. The stationary spray showerheads cause water to flow through the construction to contact essentially the same points on a user's body in a repetitive fashion.

Multifunction showerheads are able to deliver water in many different spray patterns such as a fine spray, a coarse spray, a pulsating spray, or even a flood pattern providing high fluid flow but decreased velocity. Of course, many other spray patterns may also be provided.

A conventional multifunction showerhead generally requires the user to turn a selector ring or dial on the showerhead faceplate in order to select a desired function. Another approach is to provide a faceplate with several spray jets located in concentric circular patterns. An internal controller, such as controlled by buttons or the like, may be operated to direct the incoming water to any of the various patterns. Examples of such constructions are disclosed in U.S. Pat. Nos. 5,433,384 and 6,622,945.

Unfortunately, these conventional multifunction controllers suffer from various drawbacks. For example, turning a ring or pushing a button adjacent to the showerhead can be difficult to perform by persons having soapy hands. Furthermore, the showerhead's spray still originates at basically the same location, and thus does not provide a user with the ability to vary where the spray comes from.

A handheld showerhead typically includes a hollow handle connected to a water supply by a flexible rubber hose. Handheld showerheads allow a person to adjust the location and angle of the spray head, and thus where the spray originates and where the spray goes. However, handheld showerheads suffer other problems. In addition to having the above-described drawbacks of it being difficult to rotate a selector dial or push a button with soapy hands, a person holding the handheld showerhead must utilize one's hands to hold the showerhead which can make it difficult for a person to apply soap or shampoo.

More recently, shower stalls have been provided with a primary showerhead, and additional nozzles which project directly from the shower stall's walls and which spray water in different directions than the primary showerhead. Unfortunately, these constructions require that expensive plumbing additions be made to the shower stall facility. Further, the wall nozzles cannot be moved to provide the variety that would be desirable for a shower user.

Thus, it would further be advantageous to provide a showerhead assembly that included a primary spray head as well as one or more secondary spray heads which can be located at different locations within a shower stall.

Further, it would be advantageous to provide a showerhead assembly that included nozzles that could be moved throughout a shower stall which did not require expensive modifications to the traditional shower stall architecture.

SUMMARY OF THE INVENTION

Briefly, in accordance with the invention, an improved showerhead assembly is provided including a primary showerhead and one or more ancillary showerheads. Preferably, the primary showerhead has a relatively traditional construction including a showerhead body having a central conduit for transporting water to one or more spray nozzles for spraying water. The showerhead body is connected to a water source by a neck portion which preferably includes a female threaded inlet for connecting to a male threaded pipe providing the source of water. The neck portion includes a conduit for transporting water from the water source to the primary showerhead's central conduit before then being sprayed from the showerhead body's spray nozzles.

In addition to the primary showerhead, the showerhead assembly includes one or more ancillary showerheads which are connected to the showerhead body by flexible hoses. For each ancillary showerhead, the showerhead body includes an ancillary conduit which extends radially from the showerhead body's central conduit to the showerhead body's exterior. In addition, the showerhead assembly includes a flexible hose which extends from each ancillary conduit's outlet to an ancillary showerhead for spraying water from the ancillary showerhead's nozzles. Preferably, each ancillary showerhead includes a structure for affixing the ancillary showerhead to a shower stall wall. The ancillary showerhead may be affixed to a wall using any type of mechanical fastener as can be determined by one skilled in the art including, but not limited to, adhesives, hook and pile fasteners, suction cups, or mechanical threaded fasteners such as screws. However, in a preferred embodiment, each ancillary showerhead includes a magnet for affixing the hose nozzle to a metal surface such as a small plate which has been affixed to a shower stall wall with an adhesive.

A preferred showerhead assembly includes one or more spools rotatably mounted to the showerhead body. Each showerhead spool has a circumferential outer surface which may be cylindrical or concave. The spool is rotatable back and forth from a wound condition to an unwound condition, and preferably the showerhead assembly includes a spring for biasing the spool into the wound direction. The spring may be of any type as can be determined by those skilled in the art such as a helical spring, coil spring, or elastic spring. However, in a preferred embodiment, the spool is biased into the wound condition by a flat spiral torsion spring.

Each ancillary showerhead's flexible hose is wrapped around a spool in a manner that allows the flexible hose to be retractable and extendable relative to the showerhead's body. More specifically, the flexible hose is in a retracted condition when wrapped around the spool's circumferential surface when the spool is rotated so as to be within a wound condition, but the flexible hose is extendable so as to not be wrapped around the spool's circumferential surface when the spool is rotated to an unwound condition.

In preferred embodiments, the showerhead assembly includes one or more ratchet assemblies which are capable of inhibiting the rotation of a spool into the wound direction. Various ratchet assembly constructions can be employed as can be determined by those skilled in the art. However, in a preferred embodiment, the showerhead assembly includes two ratchet assemblies for inhibiting the rotation of two spools, and each ratchet assembly has a relatively traditional construction including a plurality of teeth and a pawl biased to engage the teeth. Preferably, the teeth are affixed to a spool in an annular configuration about the spool's center of rotation. Preferably, each tooth has a moderate sloped sliding edge and a steeped sloped engagement edge. The pawl is positioned relative to the teeth in a manner that allows the spool to freely rotate in the unwound direction with the pawl sliding over the teeth's sliding edge. This occurs upon pulling a hose's distal end so as to rotate the spool in the unwound direction. However, the pawl is positioned to catch against the teeth's engagement edges wherein the spool is rotated in the wound direction so as to prevent the spool from rotating in the wound direction. In addition, the ratchet assembly includes a button wherein depression of the button causes the pawl to move away from the ratchet assembly teeth to allow the spiral torsional spring to bias the spool into the wound direction. The button may be integrated into the pawl or a separate mechanical construction.

The showerhead assembly may include any number of ancillary showerheads, flexible hoses, spools, and ratchet assemblies. However, a preferred showerhead assembly has two ancillary showerheads, and a corresponding number of flexible hoses, spools, and ratchet assemblies. Preferably, the showerhead assembly includes a housing having a central cavity. The housing preferably has a substantially cylindrical or frustoconical shape and the showerhead body, spools, and ratchet assemblies are positioned within the housing's central cavity. In addition, the housing includes one or more openings for the passage of the one or more flexible hoses.

In operation, a person taking a shower can pull upon a hose's distal end so as to unwind the spool and extract the hose from within the showerhead assembly's housing. The corresponding ancillary showerhead is then affixed to the shower stall wall such as by utilizing a magnet or the like. In a preferred embodiment, the ancillary showerhead is affixed to the distal end of the hose and shower stall wall by a swivel mount such as a ball joint so as to allow the user to adjust the direction that the ancillary showerhead nozzles spray water.

Therefore, it as an object of the present invention to provide a showerhead assembly which includes a primary showerhead as well as one or more ancillary showerheads which can be located at different locations within a shower stall.

It is still an additional object of the invention to provide a showerhead assembly that includes a plurality of nozzles that can be moved throughout a shower stall which does not require expensive additions or modifications to a traditional shower stall architecture.

These and other more specific advantages will be apparent to those skilled in the art from the following description taken in conjunction with the drawings.

DETAILED DESCRIPTION OF THE INVENTION

Figure 1:
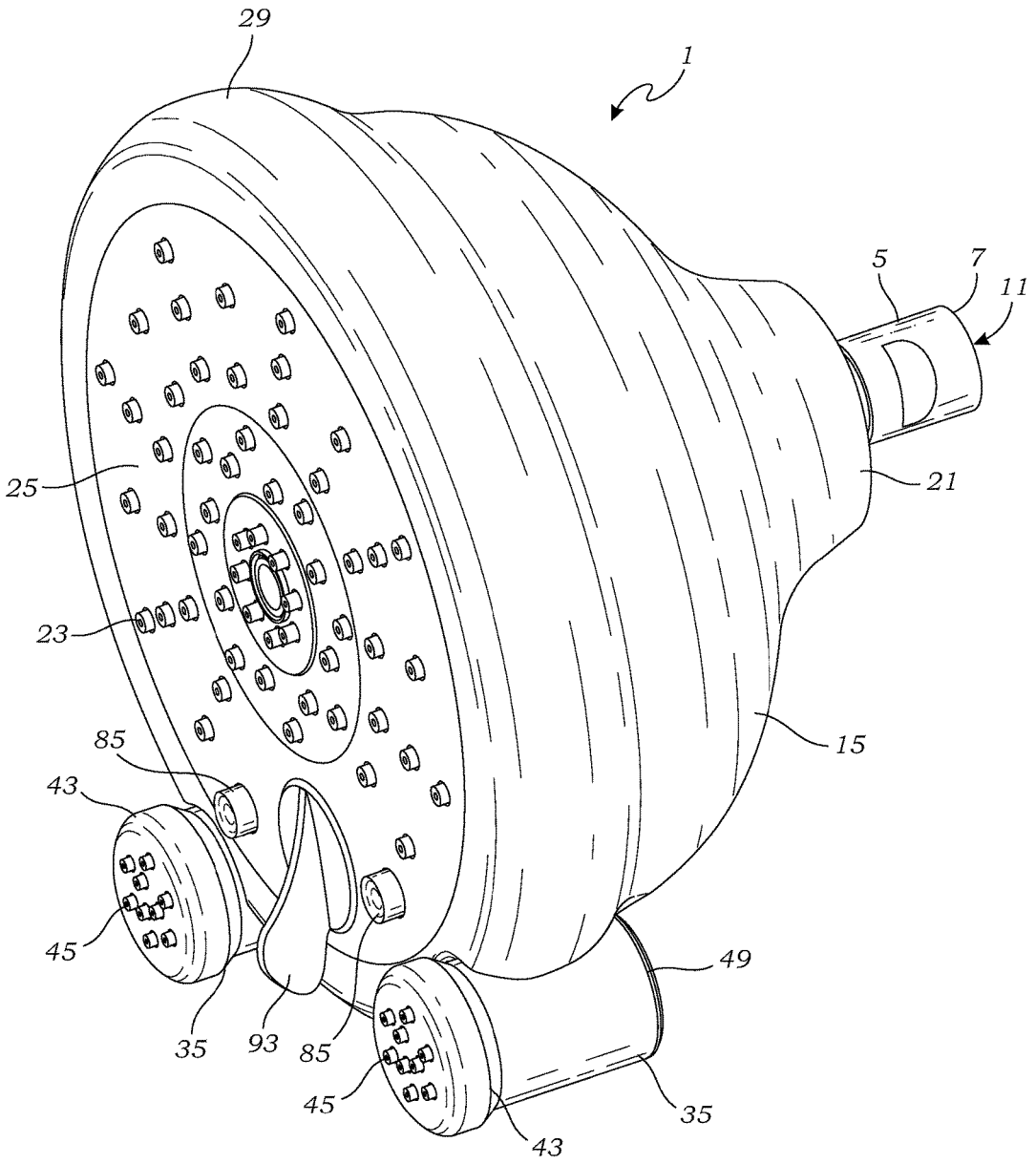
FIG. 1 is a perspective view of the showerhead assembly of the present invention.
Figure 2:
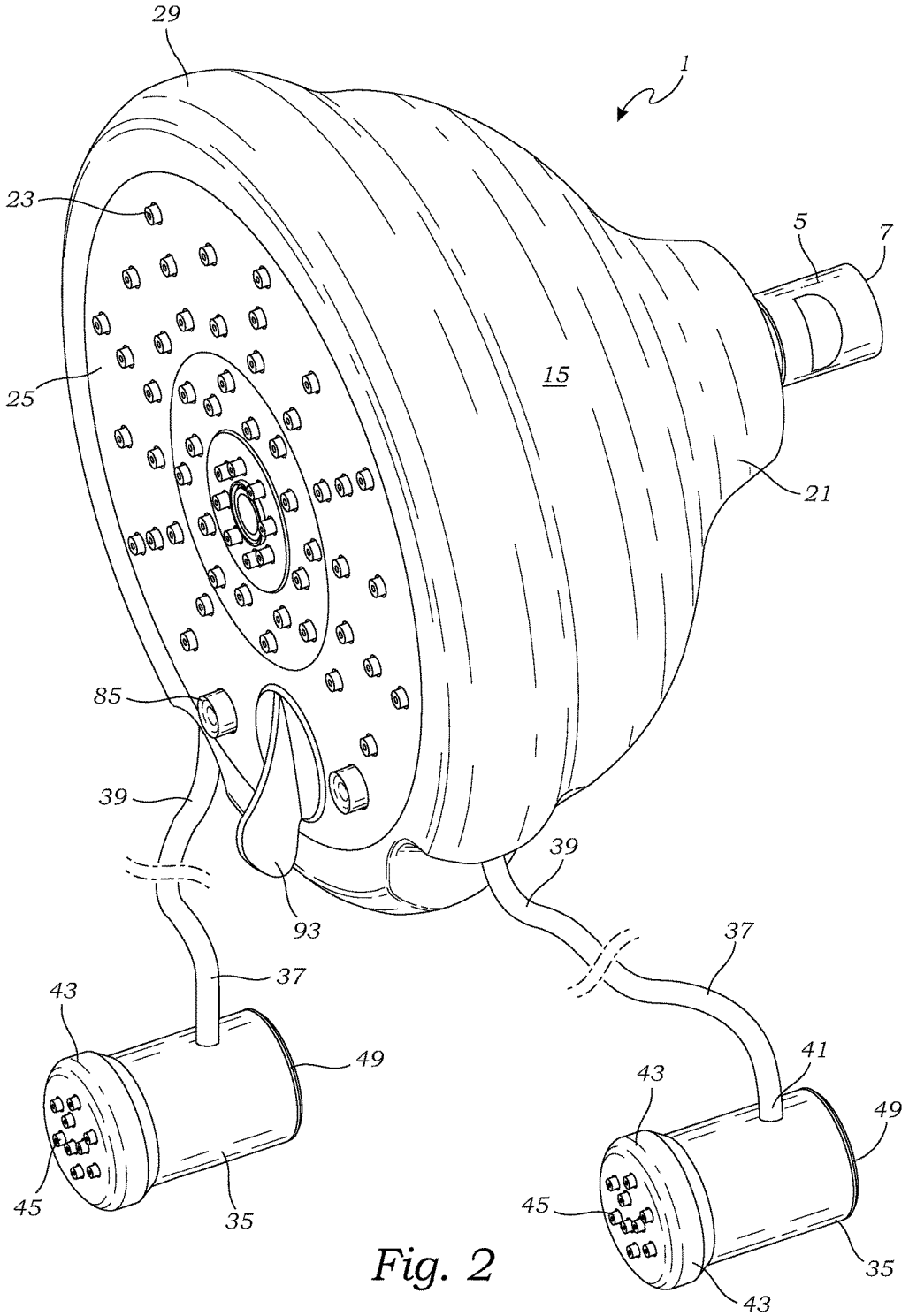
FIG. 2 is a perspective view of the showerhead assembly with ancillary showerheads extended.
Figure 3:
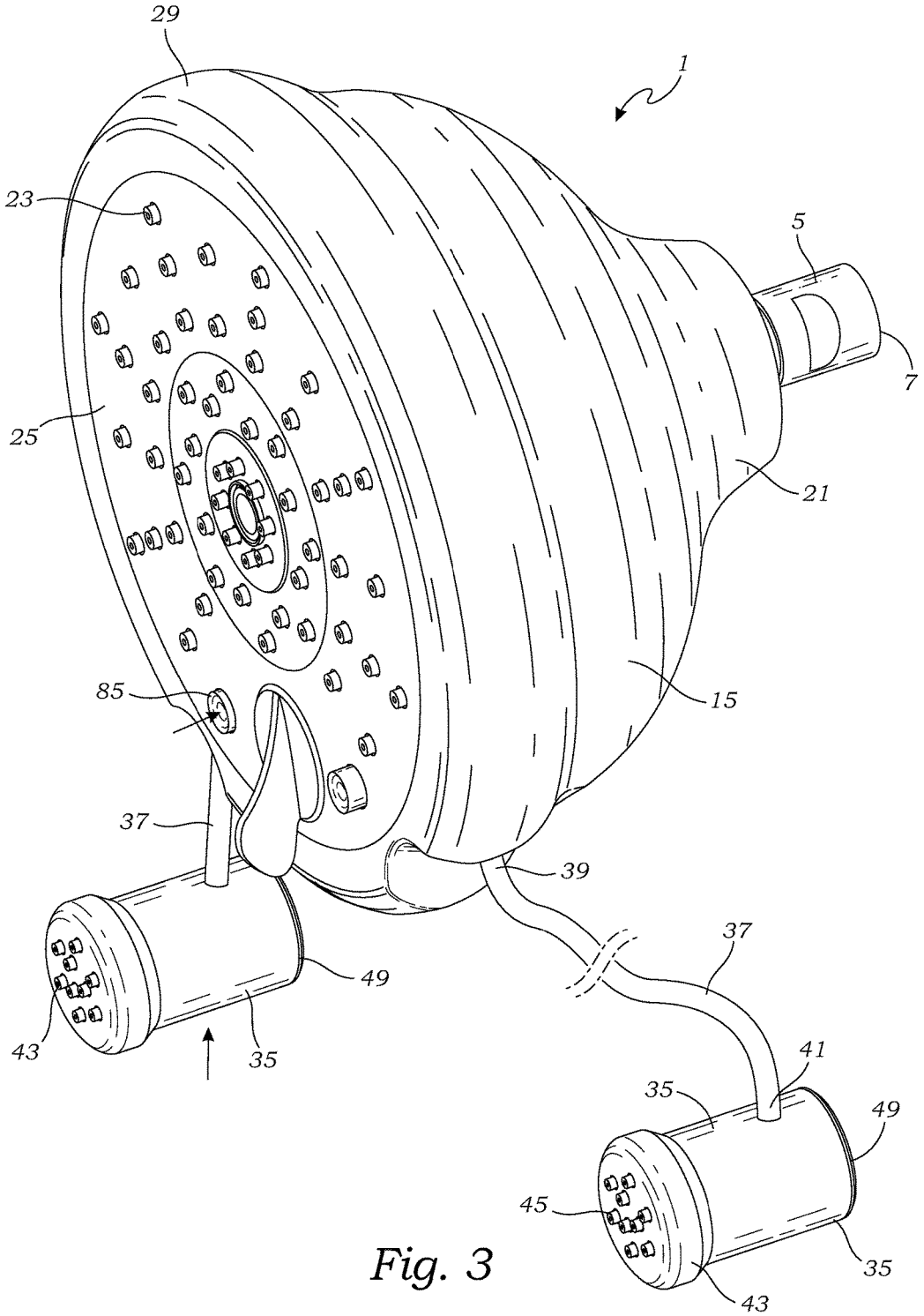
FIG. 3 is a perspective view of the showerhead assembly with an ancillary showerhead retracted.

While the present invention is susceptible of embodiment in various forms, as shown in the drawings, hereinafter will be described the presently preferred embodiments of the invention with the understanding that the present disclosure is to be considered an exemplification of the invention, and the present disclosure is not intended to limit the invention to specific embodiments illustrated.

With reference to FIGS. 1-12, the showerhead assembly 1 includes both a primary showerhead 15 and one or more ancillary showerheads 35. For purposes herein, the showerhead assembly 1 will be described as including two ancillary showerheads 35. However, the showerhead assembly may include any number of ancillary showerheads and a showerhead assembly including two ancillary showerheads is presented as simply a preferred embodiment.

The primary showerhead 15 may incorporate various constructions known to those skilled in the art. For example, as illustrated in the figures, the primary showerhead includes nozzles 23 which may have a relatively simple and traditional circular orientation for providing a simple spray pattern. However, the primary showerhead may incorporate more complex constructions for providing selectable and controllable spray patterns. Accordingly, as but an example illustrated in the figures, the showerhead assembly 1 may include a controller 93 for selectively controlling the flow of water through various conduits, such as the central conduit 19.

As best illustrated in FIGS. 4-7, the primary showerhead 15 includes a showerhead body 17 having a central conduit 19 for transporting water from a water supply to nozzles 23 which extend from a faceplate 25. In addition, the showerhead assembly 1 includes a neck portion 5 for connecting the showerhead assembly to a water source such as a male threaded pipe 99 (illustrated in FIGS. 11 and 12). To connect the showerhead assembly 1 to a male threaded pipe 99, the neck portion 15 includes a female threaded inlet 7. Furthermore, the neck portion 15 is hollow so as to include a conduit for allowing water to pass from the male threaded pipe 99 to the primary showerhead's body 17. The primary showerhead 15 may be connected to the neck portion 5 by various constructions known to those skilled in the art. However, in a preferred embodiment, the neck portion 5 and primary showerhead 15 are connected by a ball joint wherein the neck portion 5 includes a ball received within a spherical cavity found in the primary showerhead's proximal end which allows the primary showerhead 16 to swivel relative to the neck portion 5.

Figure 4:
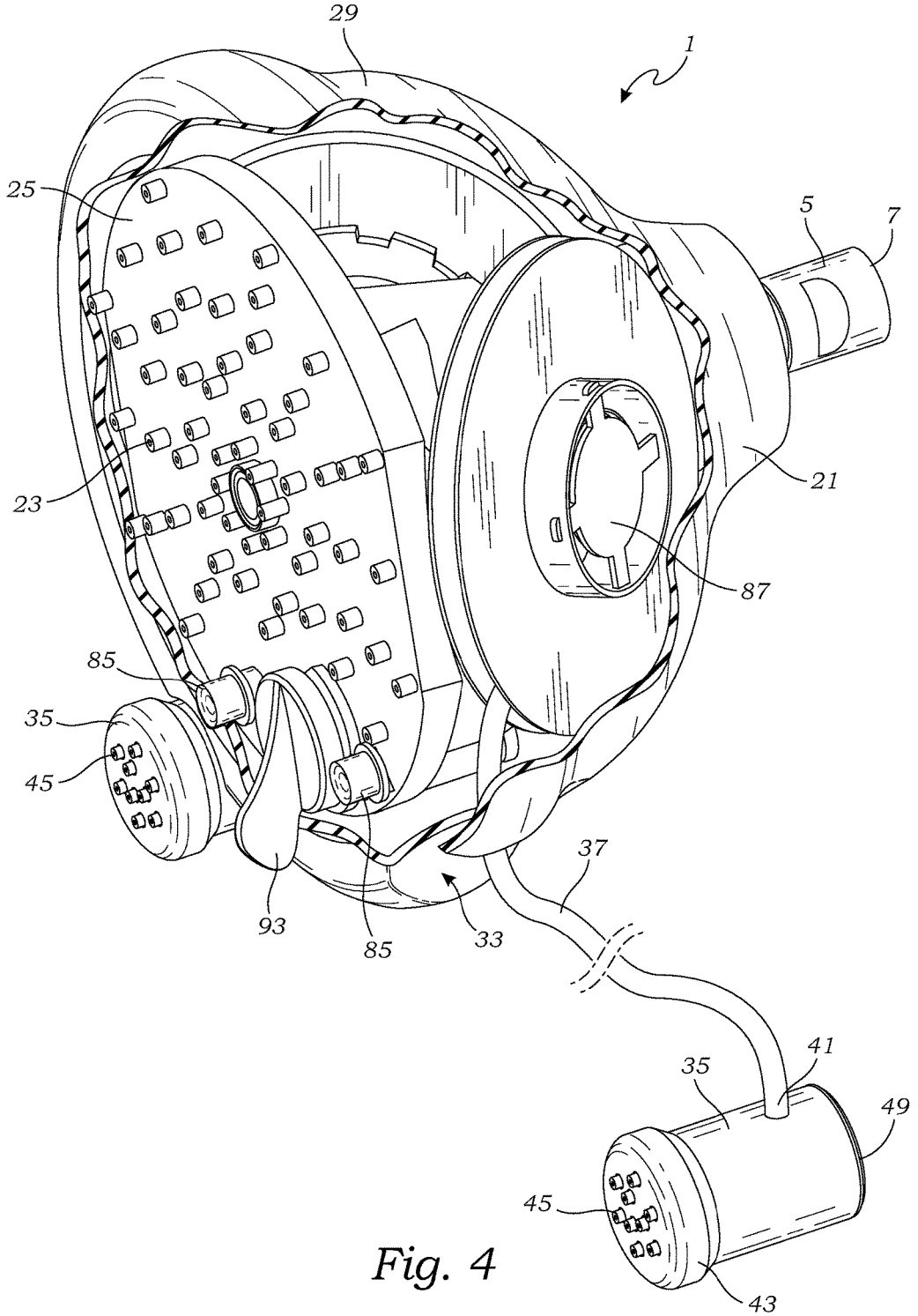
FIG. 4 is a perspective cutaway view of the showerhead assembly with a retracted ancillary showerhead and an extended ancillary showerhead.
Figure 5:
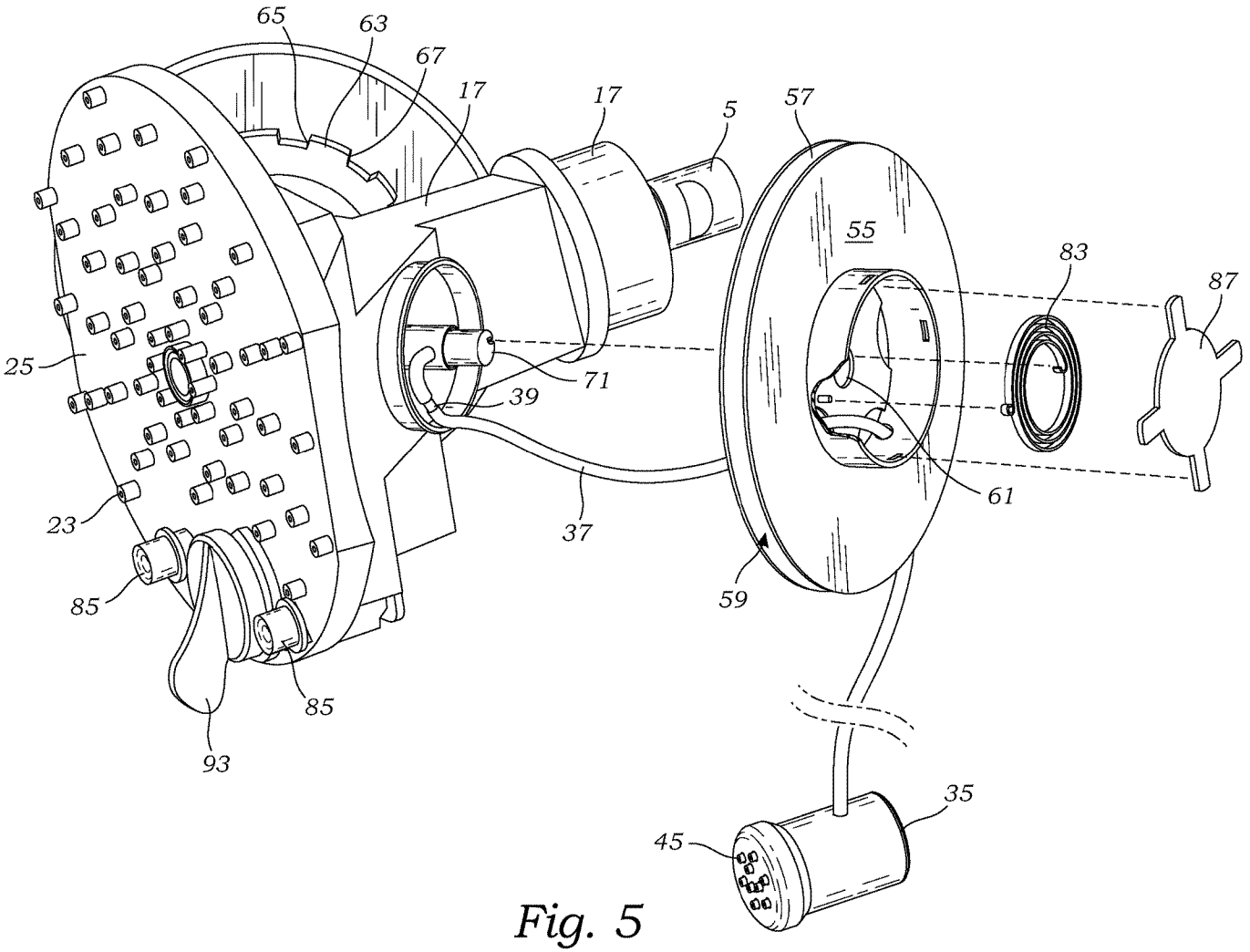
FIG. 5 is a perspective exploded cutaway view illustrating the showerhead assembly's showerhead body, spool and an ancillary showerhead.
Figure 6:
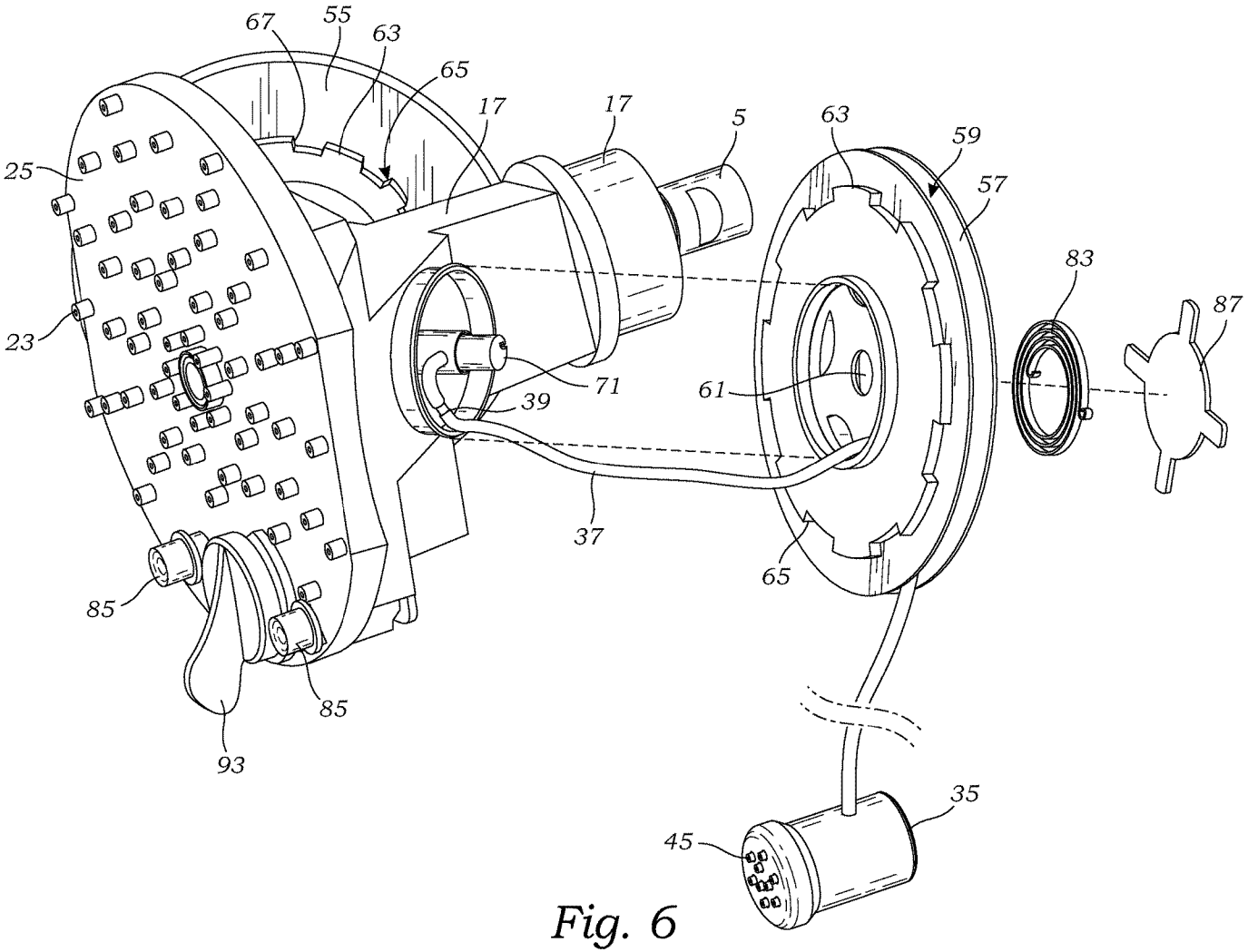
FIG. 6 is an additional perspective exploded cutaway view of the showerhead assembly's showerhead body, spool and ancillary showerhead.
Figure 7:
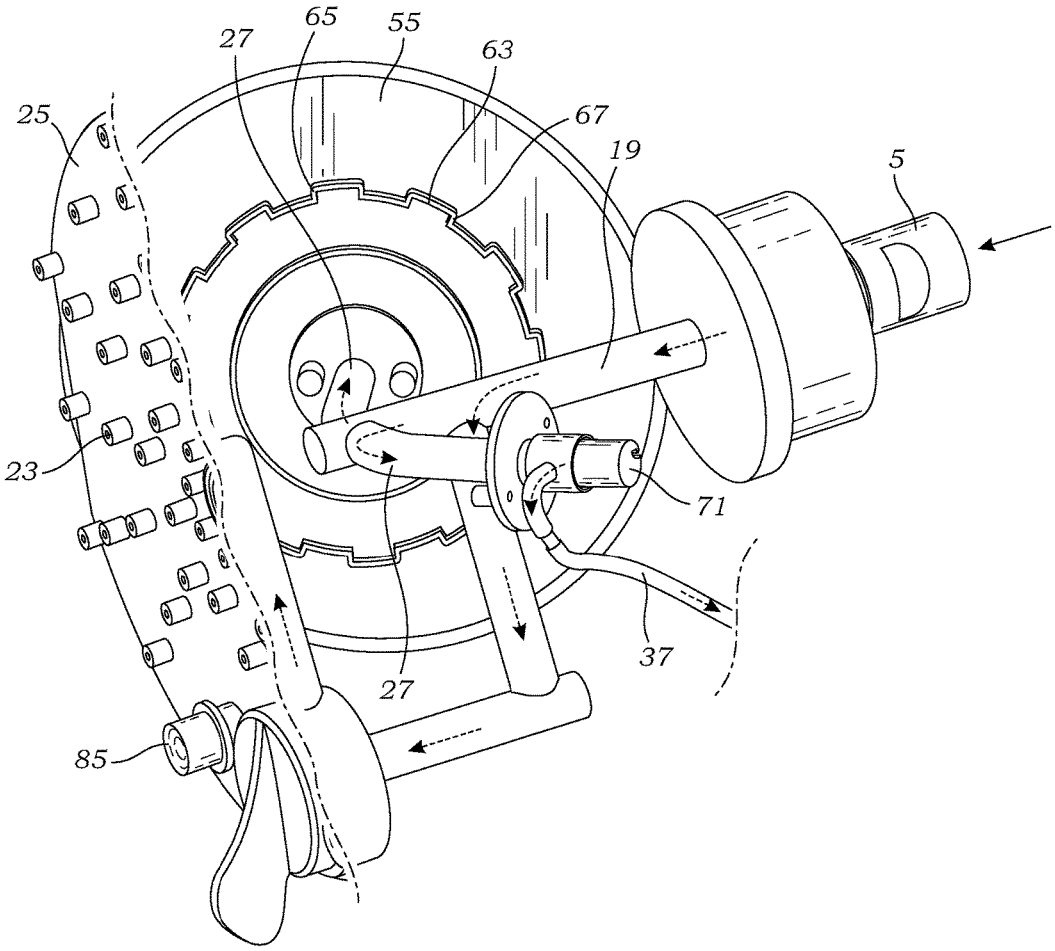
FIG. 7 is a side cutaway view illustrating the water flow paths through the showerhead body including the showerhead body's central conduit and ancillary conduits.

In a preferred embodiment illustrated in FIG. 4, the primary showerhead 15 includes a housing 29 having a cavity 31 for encapsulating the primary showerhead's body. With reference to FIGS. 1-12, the showerhead assembly's ancillary showerheads 35 include a housing 43 having one or more spray nozzles 45. Each ancillary showerhead 35 and its nozzles 45 are connected to the primary showerhead's body 17 by a flexible hose 37. To this end, as best illustrated in FIG. 7, the showerhead body includes two ancillary conduits 27 which are connected to the showerhead body's central conduit 19. Each of the flexible hoses' proximal ends 39 is connected to the ancillary conduit 27, and each of the flexible hoses' distal ends 41 is connected to an ancillary showerhead 35. The flexible hoses 37 travel through openings 33 formed in the housing 29. The housing's openings 33 are sufficiently large so as to allow the flexible hoses 37 to freely retract into the housing's cavity 31, or to slidably extend through the housing's openings 33 to exterior of the primary showerhead 15. Preferably, each of the ancillary showerheads' housing's back surfaces is substantially planar and includes a magnet 49 for affixing to metal surfaces.

A preferred showerhead assembly 1 includes a spool 55 which is rotatably mounted to the showerhead body 17. The showerhead assembly may include only one spool for winding and retracting multiple flexible hoses so that as one flexible hose is either retracted or extended, the remaining flexible hoses are extended or retracted as well. However, in the preferred embodiment illustrated in the figures, the showerhead assembly 1 includes a spool for each ancillary showerhead and flexible hose. Each spool 55 includes a circumferential surface 59 around which a flexible hose 37 can be wrapped. Preferably, the circumferential surface 59 resides within an annular recess 57 which forms a channel for accepting a flexible hose as it is wound around the spool's circumferential surface 59. Each spool 55 may be rotatably affixed to the showerhead body by any number of constructions as can be determined by those skilled in the art so as to allow one body to rotate relative to another. As illustrated in FIGS. 5-7, in a preferred embodiment, the showerhead body includes two spindles 71 which are received within holes 61 formed in each of the two spools 55. Preferably, each spool 55 is prevented from disengaging from the spindle 71 by a cover plate 87 which is affixed to the distal end of each spindle 71.

The ancillary showerhead's flexible hoses 37 are wrapped around their respective spools 55 with the rotation of the spool causing each flexible hose 37 to be retracted or extended relative to the showerhead's body 17. More specifically, as each spool 55 is rotated in a first direction so as to wind the spool, the flexible hose 37 becomes wrapped around the spool until the flexible hose is fully retracted and the ancillary showerhead housing 43 engages the primary showerhead housing 29. Preferably, the housing includes a concave recess to receive the ancillary showerhead's housing 43. Conversely, each flexible hose 37 and ancillary showerhead 35 can be extended away from the primary showerhead 15. When the ancillary showerhead 35 is pulled away from the primary showerhead 15, a flexible hose is pulled through the housing's opening 33 and the corresponding spool 55 is rotated in a second unwound direction until the flexible hose is in a fully extended unwound condition. Preferably, the showerhead assembly 1 includes a spring 83 for biasing the spool into the wound condition. The spring may be of any construction as can be determined by those skilled in the art so as to bias a rotating body. However, as illustrated in FIGS. 5 and 6, a preferred spring 83 is a flat torsional spring wherein the torsional spring's interior end is affixed to a spindle 71 and the torsional spring's exterior end is affixed to the spool 55.

As illustrated in FIGS. 4-10, the preferred showerhead assembly 1 includes a ratchet assembly which selectively inhibits the rotation of the spool 55 from rotating into the wound direction. As illustrated in the figures, the preferred ratchet assembly includes a plurality of teeth 63 which extend axially from a spool's sidewall. The teeth 63 are arranged in an annular configuration about the spool's axis of rotation. Furthermore, each tooth 63 includes an engagement edge 65 having a steep slope and a sliding edge 67 which may or may not have a steep slope. In addition, the ratchet assembly includes a movable pawl 77 which is positioned to catch against the teeth's engagement edges 65 when the spool is rotated in the wound direction so as to prevent the spool from rotating further in the wound direction. The pawl 77 is biased against the spool teeth 63 by an additional spring 84. A preferred spring 84 is a traditional coil spring.

Figure 8:
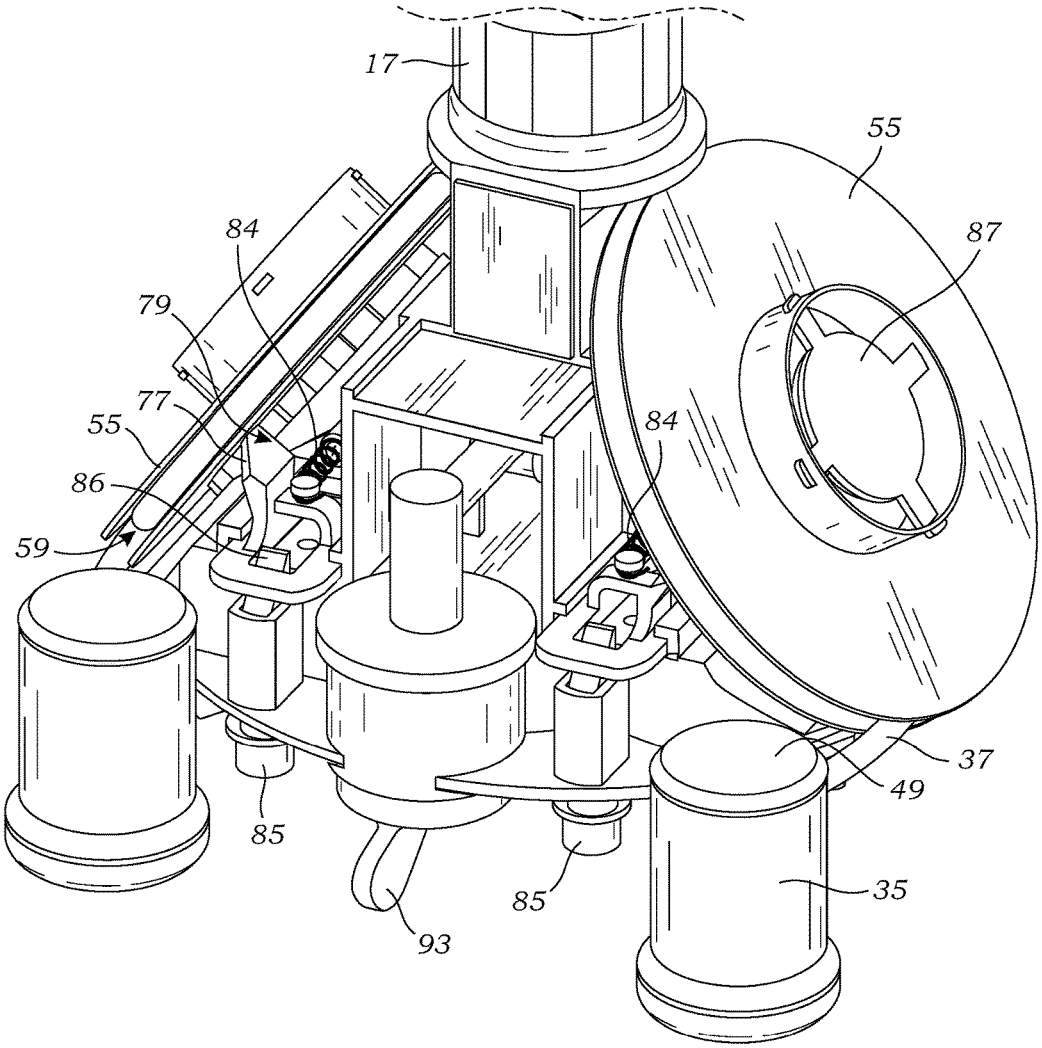
FIG. 8 is a perspective view illustrating the showerhead assembly's ratchet assemblies and spools.
Figure 9:
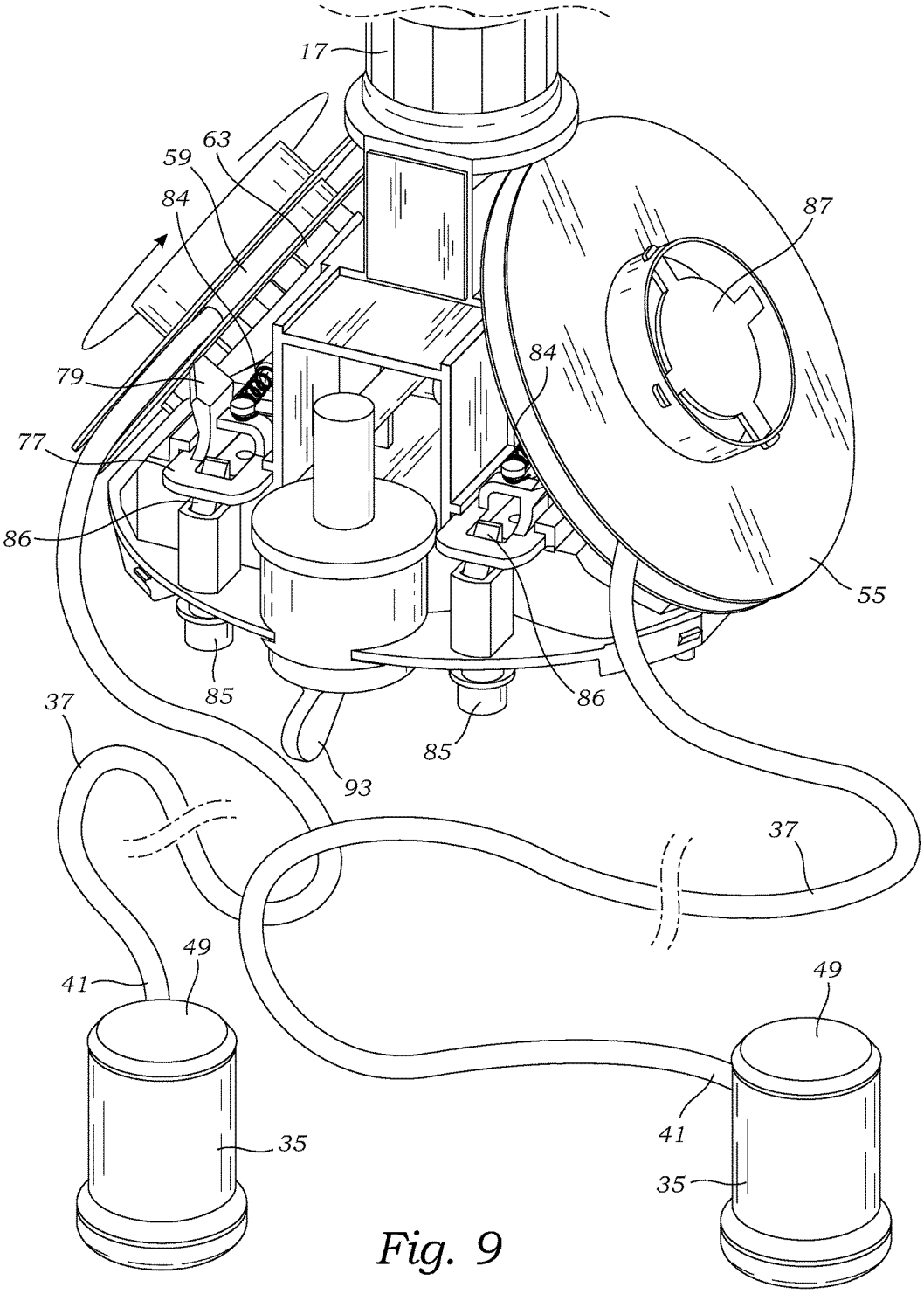
FIG. 9 is a perspective view illustrating the showerhead assembly's ratchet assemblies, spools and ancillary showerheads.
Figure 10:
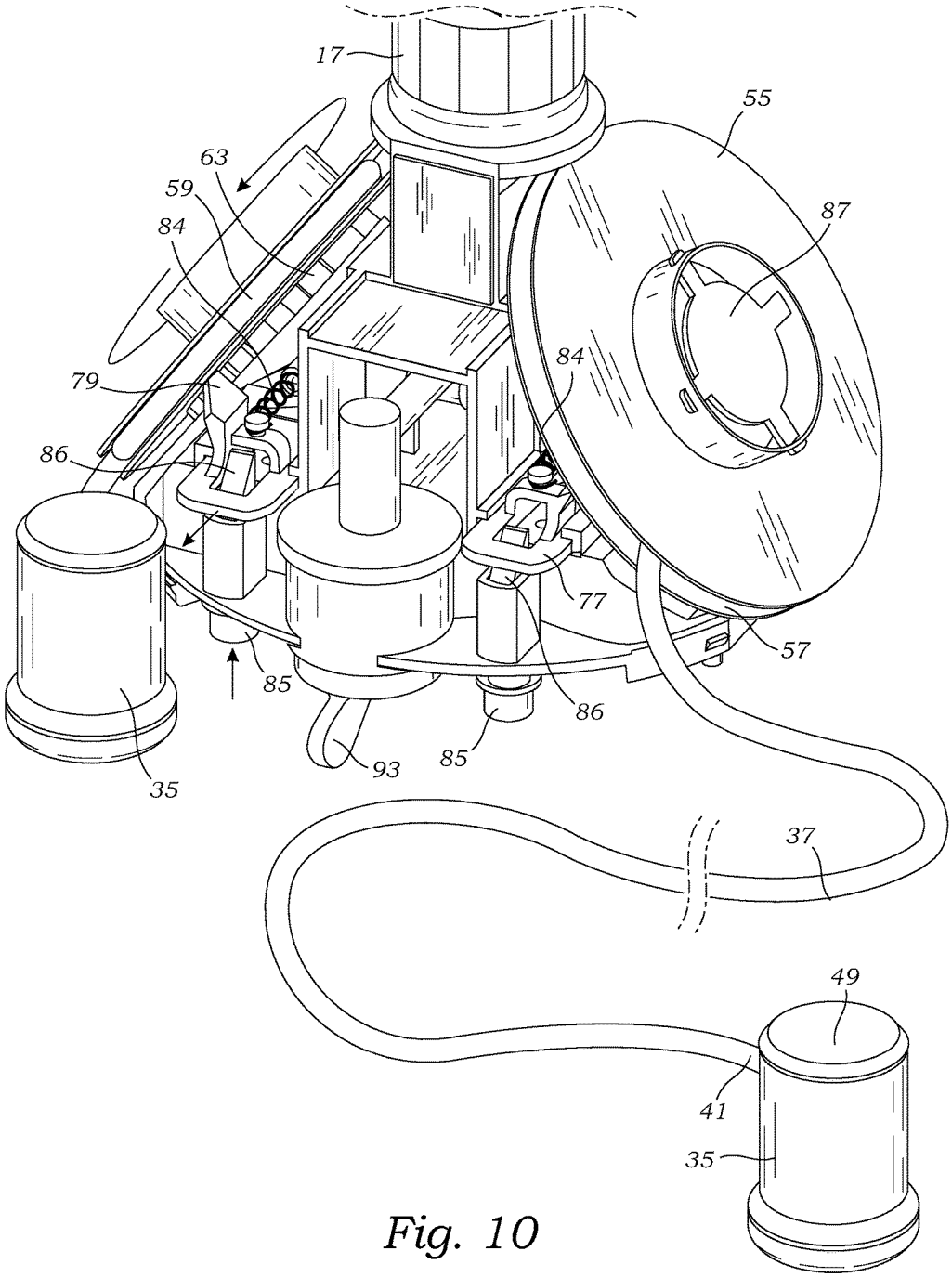
FIG. 10 is a perspective view illustrating the showerhead's ratchet assembly, spools and ancillary showerheads wherein one ancillary showerhead has been retracted and the other extended.

Moreover, the ratchet assembly includes a button 85 for biasing the pawl 77 away from the spool teeth 63. The button may form part of the pawl. However, as illustrated in FIGS. 8-10, a preferred button 85 extends from the showerhead's baseplate 25 and includes a sloped rear edge 86 which engages a hook extending from the pawl 77. As illustrated in FIG. 10, depression of the button 85 causes the button's sloped edge 86 to engage the pawl's hook to retract the pawl 77 away from the spool's teeth 63. Once retracted, the flat torsional spiral spring 83 causes the spool 55 to rotate into the wound direction so as to wind the flexible hose 37 around the spool's circumferential surface 59.

Figure 11:
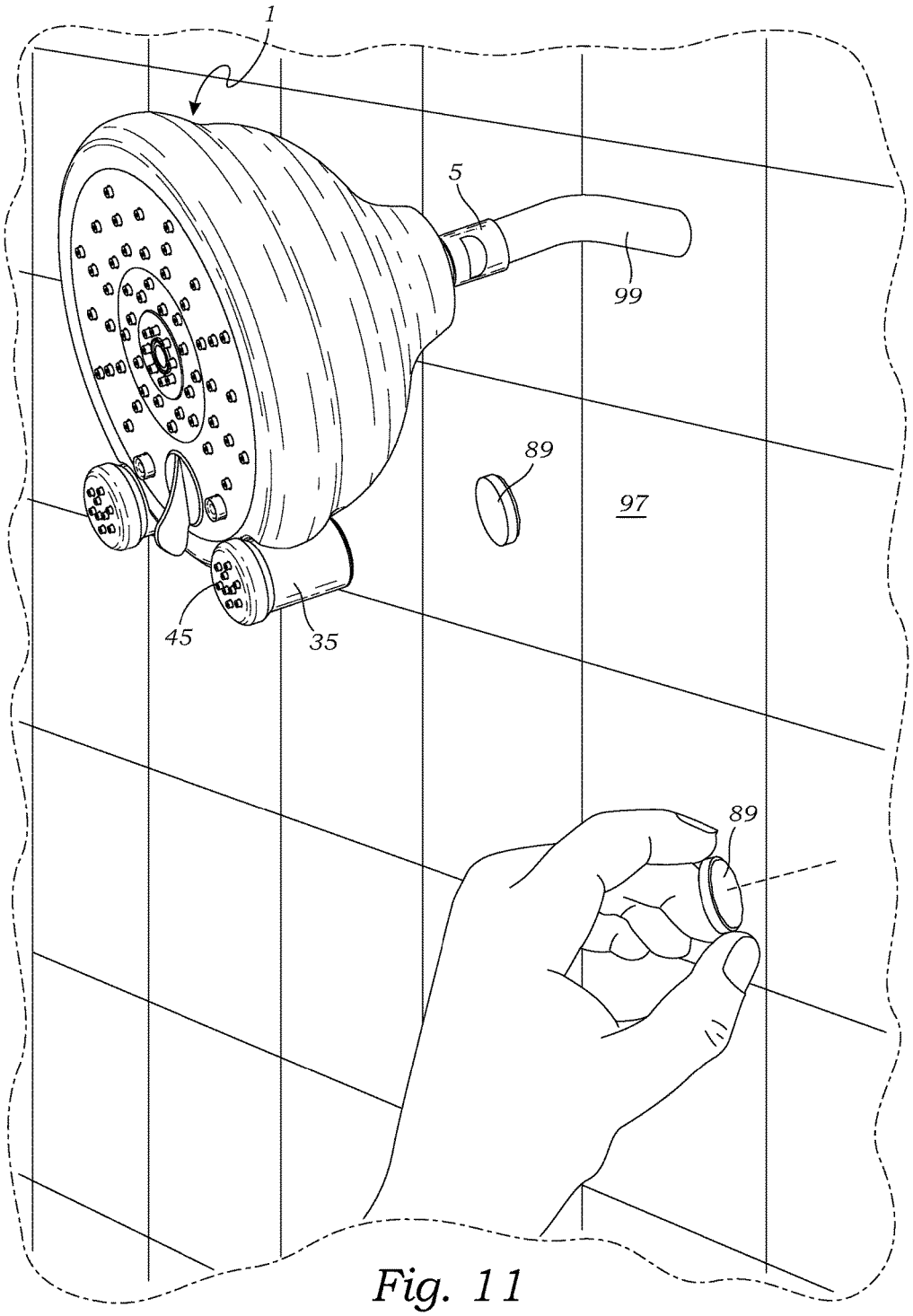
FIG. 11 is a perspective view of the showerhead assembly affixed to a pipe within a shower stall.
Figure 12:
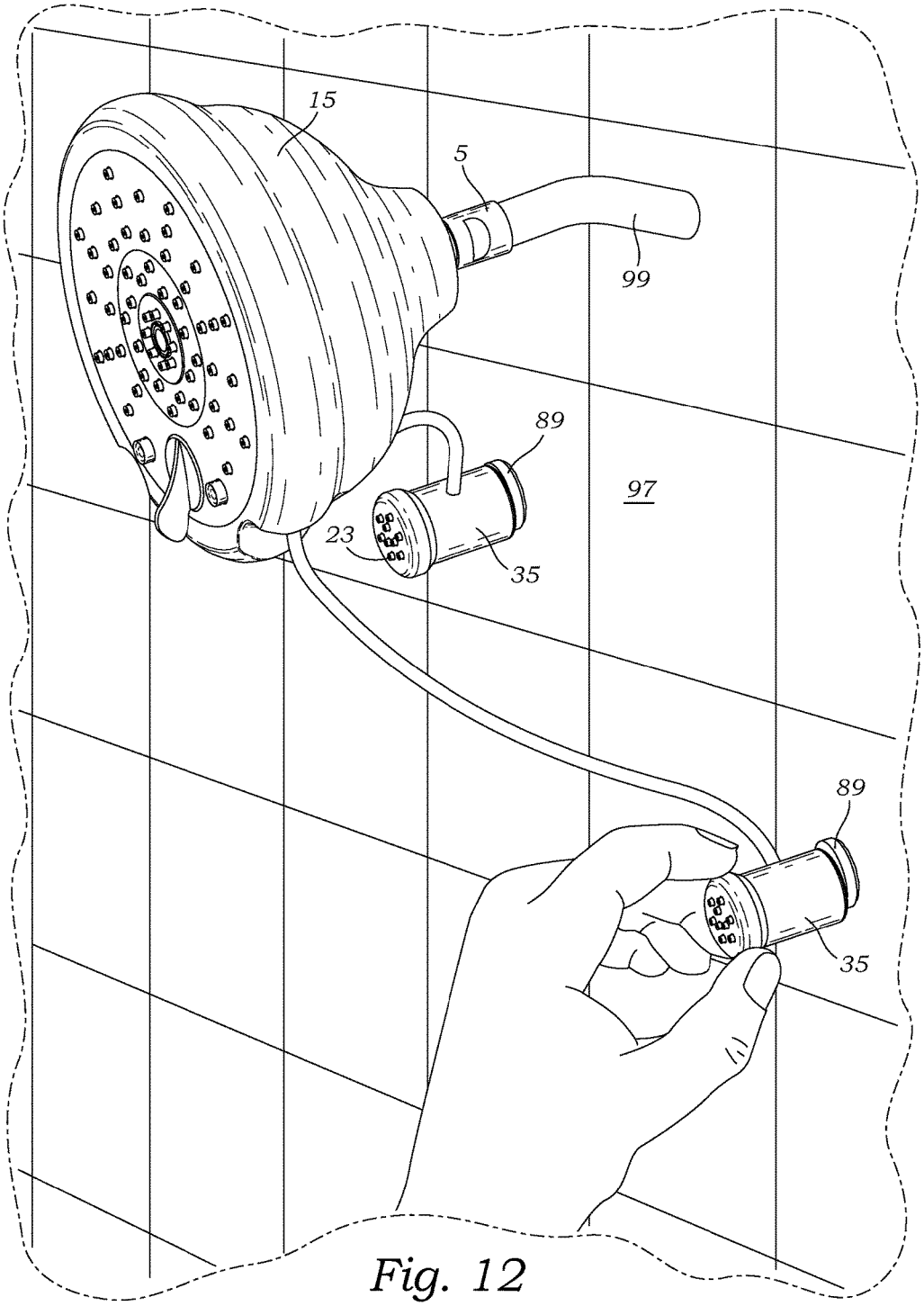
FIG. 12 is a perspective view of the showerhead assembly within a shower stall wherein the ancillary showerheads have been affixed to a wall.

As illustrated in all the figures, and particularly FIGS. 11 and 12, the showerhead assembly 1 is intended for use within a typical bathroom stall having a planar wall 97. The showerhead assembly's neck portion 5 is threadably attached to the male threads of a pipe 99. The primary showerhead 15 is positioned in the manner of a traditional showerhead. However, the ancillary showerheads 35 can be positioned anywhere against the shower stall wall 97 with such location limited only by the lengths of the flexible hoses 37. In use, a shower user positions and affixes metal wall plates 89 at desired locations upon the shower stall wall 97. As illustrated in FIGS. 4 and 12, an ancillary showerhead 35 is pulled away from the primary showerhead 15 so as to unwind a flexible hose 37 from a spool 55. The ancillary showerhead 35 is then affixed to a metal plate 89 by an ancillary showerhead's magnet 49.

In an embodiment not illustrated in the figures, the ancillary showerhead nozzles 45 are capable of tilting or pivoting relative to the shower stall wall 97. This can be accomplished utilizing hinges or pivot mounts such as a ball joint for connecting the nozzles 45 to the nozzle housing 43, or for affixing the ancillary showerhead's housing 43 against the shower stall wall 97. To return the ancillary showerhead to engagement with the primary showerhead, the aformentioned steps are reversed with the ancillary showerhead 35 being pulled away from a metal plate 89. A person then depresses the corresponding button 85 which causes a pawl 77 to disengage from spool teeth 63 to, in turn, wind the flexible hose 37 around the spool 55.

While a preferred showerhead assembly has been illustrated and described, it will be apparent that various modifications of the showerhead assembly can be made without departing from the spirit and scope of the invention. Accordingly, it is not intended that the invention be limited except by the following claims.

I claim:

1. A showerhead assembly comprising:

a hollow neck portion having a female threaded inlet adapted to attach to a male threaded pipe of a water supply and receive water into said neck portion;

a showerhead body connected to said hollow neck by a ball joint connection with said showerhead body positioned distally of said hollow neck portion, said showerhead body having a central conduit for receiving water from said neck portion, said showerhead body having nozzles connected to said central conduit for spraying water;

a first ancillary conduit connected to said central conduit so that water from said neck portion can flow through said central conduit into said ancillary conduit;

a first spool having a circumferential surface, said first spool rotatably mounted to said showerhead body with first spool being rotatable back and forth from a wound condition to a unwound condition;

a first flexible hose having a first end, a second end and a hose passageway for transporting water from said first end to said second end, said first hose's first end connected to said first ancillary conduit to receive water from said first ancillary conduit into said first hose passageway, said first flexible hose retractable and extendable relative to said showerhead body with the rotation of said first spool with said first flexible hose being retracted when wrapped around said first spool's circumferential surface when said first spool is rotated to a wound condition and said first flexible hose being extended when said first flexible hose is not wrapped around said first spool's circumferential surface when said first spool is rotated to an unwound condition;

a housing having a central cavity, said housing located distally of said neck portion and ball joint connection, said first spool positioned within said housing's central cavity, said housing having an opening for the passage of said first flexible hose allowing for said flexible hose to retract into and retract from said central cavity; and a first hose nozzle connected to said first flexible hose's second end for spraying water from said hose passageway.

2. The showerhead assembly of claim 1 further comprising:

a first spring positioned within said housing's central cavity for biasing said first spool into the wound direction;

a first ratchet assembly positioned within said housing's central cavity for inhibiting the rotation of said first spool into the wound direction, said first ratchet assembly having;

a plurality of teeth affixed in an annular configuration to said first spool with each of said teeth having a moderate sloped edge and a steep sloped edge, a pawl biased to engage said teeth with said pawl positioned to freely permit said spool to rotate in unwound direction upon pulling on said first hose's second end, but catch against said teeth' steep sloped edges to prevent said first spool from rotating in the wound direction, and a button engaging said pawl with depression of said button causing said pawl to move away from said teeth to allow said spring to bias said spool into the wound direction.

3. The showerhead assembly of claim 1 further comprising:

a first metal plate for being affixed to a planar surface; and a first magnet affixed to said first nozzle.

4. The showerhead assembly of claim 1 further comprising:

a second ancillary conduit connected to said central conduit so that water from said neck portion can flow through said central conduit into said ancillary conduit;

a second spool having a circumferential surface, said second spool rotatably mounted to said showerhead body with second spool being rotatable back and forth from a wound condition to a unwound condition;

a second flexible hose having a first end, a second end and a hose passageway for transporting water from said first end to said second end, said second hose's first end connected to said second ancillary conduit to receive water from said second ancillary conduit into said second hose passageway, said second flexible hose retractable and extendable relative to said showerhead body with the rotation of said second spool with said second flexible hose being retracted when wrapped around said second spool's circumferential surface when said second spool is rotated to a wound condition and said second flexible hose being extended when said second flexible hose is not wrapped around said second spool's circumferential surface when said second spool is rotated to an unwound condition; and a second hose nozzle connected to said second flexible hose's second end for spraying water from said hose passageway.

5. The showerhead assembly of claim 4 further comprising:

a second spring for biasing said second spool into the wound direction;

a second ratchet assembly for inhibiting the rotation of said second spool into the wound direction, said second ratchet assembly having;

a plurality of teeth affixed in an annular configuration to said second spool with each of said teeth having a moderate sloped edge and a steep sloped edge, a pawl biased to engage said teeth with said pawl positioned to freely permit said spool to rotate in unwound direction upon pulling on said first hose's second end, but catch against said teeth' steep sloped edges to prevent said second spool from rotating in the wound direction, and a button engaging said pawl with depression of said button causing said pawl to move away from said teeth to allow said spring to bias said second spool into the wound direction.

6. The showerhead assembly of claim 5 further comprising:

a housing having a central cavity with said showerhead body, said first and second spools, said first and second springs and said first and second ratchet assemblies positioned within said central cavity, said housing having a first opening for the passage of said first flexible hose and a second opening for the passage of said second flexible hose.

7. The showerhead assembly of claim 4 further comprising:

a second metal plate for being affixed to a planar surface; and a second magnet affixed to said second nozzle.

* * * * *